US008359670B2

(12) United States Patent
Mazzarolo

(10) Patent No.: US 8,359,670 B2
(45) Date of Patent: Jan. 29, 2013

(54) ARTICLE TO BE ARRANGED AT THE SOLE OF A HUMAN FOOT

(75) Inventor: Daniela Mazzarolo, Treviso (IT)

(73) Assignee: SPM s.r.l., San Zenone Degli Ezzelini (Treviso) (IT)

( * ) Notice: Subject to any disclaimer, the term of this patent is extended or adjusted under 35 U.S.C. 154(b) by 0 days.

(21) Appl. No.: 12/450,582

(22) PCT Filed: Jul. 24, 2008

(86) PCT No.: PCT/EP2008/006065

§ 371 (c)(1), (2), (4) Date: Oct. 1, 2009

(87) PCT Pub. No.: WO2009/015820

PCT Pub. Date: Feb. 5, 2009

(65) Prior Publication Data

US 2010/0299809 A1 Dec. 2, 2010

(30) Foreign Application Priority Data

Aug. 1, 2007 (IT) ..... VI2007A0211

(51) Int. Cl.
*A41B 11/00* (2006.01)

(52) U.S. Cl. ..... 2/239

(58) Field of Classification Search ..... 2/239, 240, 2/241, 409, 61; 36/11.5, 43, 28, 25 R, 29; D2/989, 980, 961, 947, 951, 954
See application file for complete search history.

(56) References Cited

U.S. PATENT DOCUMENTS

| | | | | |
|---|---|---|---|---|
| 4,033,054 | A * | 7/1977 | Fukuoka | 36/11.5 |
| 4,206,514 | A * | 6/1980 | Yamauchi | 2/239 |
| 4,651,354 | A * | 3/1987 | Petrey | 2/239 |
| 5,950,239 | A | 9/1999 | Lopez | |
| 6,176,025 | B1 * | 1/2001 | Patterson et al. | 36/28 |
| D446,637 | S * | 8/2001 | Patterson et al. | D2/961 |
| 6,275,997 | B1 * | 8/2001 | Richardson | 2/239 |
| 7,318,291 | B2 * | 1/2008 | Wang et al. | 36/141 |
| 7,346,936 | B2 * | 3/2008 | Vargas et al. | 2/239 |
| 2004/0221371 | A1 * | 11/2004 | Kato | 2/239 |
| 2005/0253018 | A1 * | 11/2005 | George, Jr. | 244/118.5 |
| 2006/0195971 | A1 * | 9/2006 | Lambertz | 2/239 |

FOREIGN PATENT DOCUMENTS

| | | | |
|---|---|---|---|
| EP | 0 436 764 | A | 7/1991 |
| EP | 0 428 474 | A | 5/1992 |
| EP | 1 516 550 | A | 3/2005 |
| GB | 1 560 887 | A | 2/1980 |
| WO | WO 96/24268 | A | 8/1996 |
| WO | WO 00/59414 | A | 10/2000 |

OTHER PUBLICATIONS

International Search Report.

* cited by examiner

*Primary Examiner* — Khoa Huynh
*Assistant Examiner* — Brieanna Fuller
(74) *Attorney, Agent, or Firm* — Bucknam and Archer

(57) ABSTRACT

There is provided an article to be arranged at the sole of a human foot, in particular for practicing sports and physical activities. In particular the article relates to a sock, to be used mainly for practicing sports and physical activities (for example golf), wherein on the zone of the sock (P) arranged at the sole of the foot, one or more plates (1-6) made of plastic material containing ferrite are arranged on the external surface of the sock.

4 Claims, 2 Drawing Sheets

DX

SX

ARTICLE TO BE ARRANGED AT THE SOLE OF A HUMAN FOOT

CROSS REFERENCE TO RELATED APPLICATIONS

This application is the National Stage of PCT/EP2008/006065 filed on Jul. 24, 2008 which claims priority under 35 U.S.C. §119 of Italian Application No. VI2007A000211 filed on Aug. 1, 2007. The international application under PCT article 21(2) was published in English.

The present finding regards an article to be arranged at the sole of a human foot; in particular said article is suitable for use in sports and physical activities in general.

It is known that when walking and in particular during sports and physical activities in general, problems regarding both the feet directly as well as other organs of the body connected to the feet through the muscular fascias and joint organs often arise. Very often, these inconveniences are due to a poor posture of the person walking and/or the athlete; the event is particularly accentuated by the reasons exhaustively outlined in Philippe Dudal's text (adaptation by G. Struyf-Denys) "Les chaines muscolaires et articulaires" ed. SBO & RTM. In practice, given that posture is a non-linear system, actually there is no proportionality between the stimulus delivered to the muscular and joint chains and the response that determines the stimulus itself. It is thus sufficient, both positively and negatively, to confer a reduced stimulus to a part of the sole of the foot to obtain great advantages or, on the contrary, to create considerable disadvantages. Obviously, the problem lies in conferring the "correct stimulus" to one or more parts of the sole of the foot to obtain the desired advantage.

This is obtained, according to the finding, by providing an article to be arranged at said sole of the foot, having at least one plate made of plastic material containing ferrite (common ferromagnetic material), arranged on the surface which ends up laid on said sole of the foot.

Advantageously, this article shall actually be made up of a sock having one or more plates made of plastic material containing ferrite, arranged on the external surface of the sock itself.

This and other characteristics of the finding shall be described in detail hereinafter, with reference to one of its embodiments, provided for exemplifying and non-limiting purposes with special reference to a sock, with the help of the drawings attached, wherein.

Figure 5:
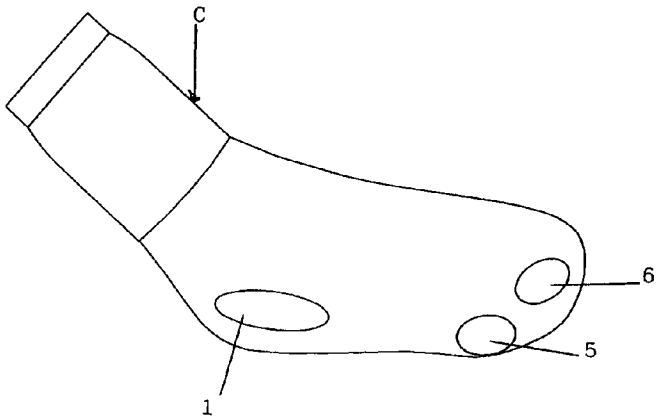
Figure 4:
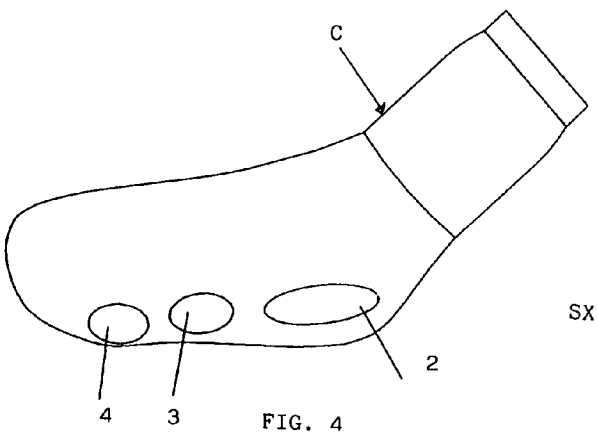

FIGS. 4 and 5 vice versa represent two views, in vertical sections, of the left sock made according to the embodiment mentioned above.

Figure 1:
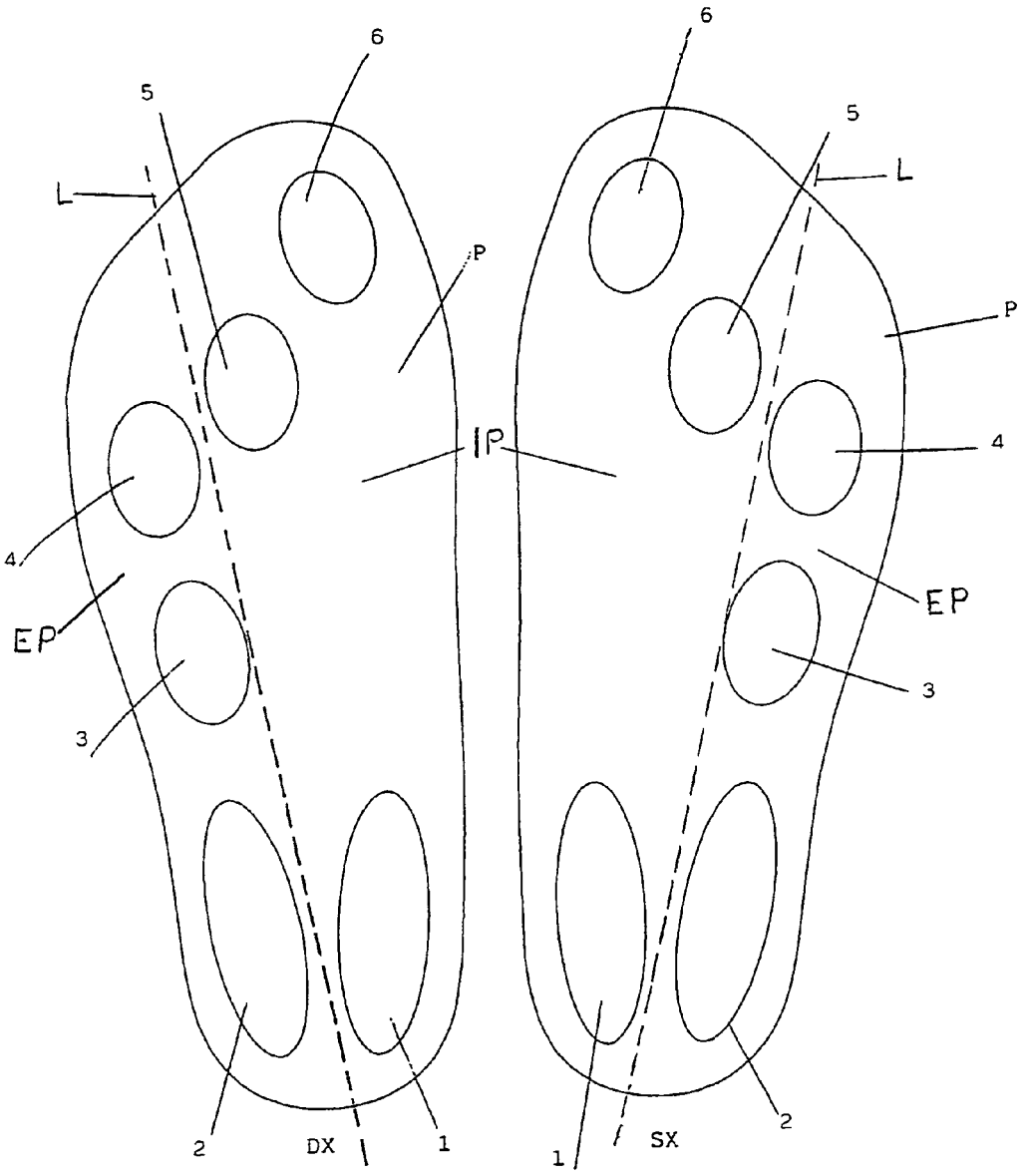
FIG. 1 (tab. I) represents two socks made according to a first embodiment of the finding, with the view of the zone which is arranged at the sole of the feet of the user.

As observable in FIG. 1, according to the finding, in the zone P of the sock to be arranged at the sole of the foot, provided for is the presence of at least one plate made of flexible material containing ferrite, arranged at the external surface of the sock itself and integral with the abovementioned.

As clearly seen in FIG. 1, a longitudinal line L (shown in phantom) extends from the toe portion to the heel portion of the sole of the sock demarcating the sole into an internal sole portion IP and an external sole portion EP.

Figure 3:
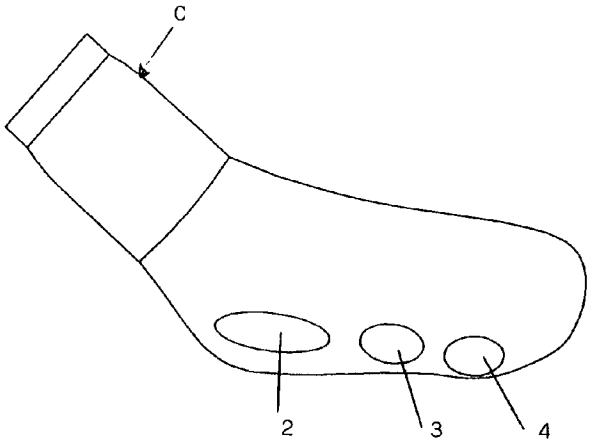
FIGS. 2 and 3 (tab. II) represent two views, in vertical sections, of a right sock made according to said embodiment of the finding.
Figure 2:
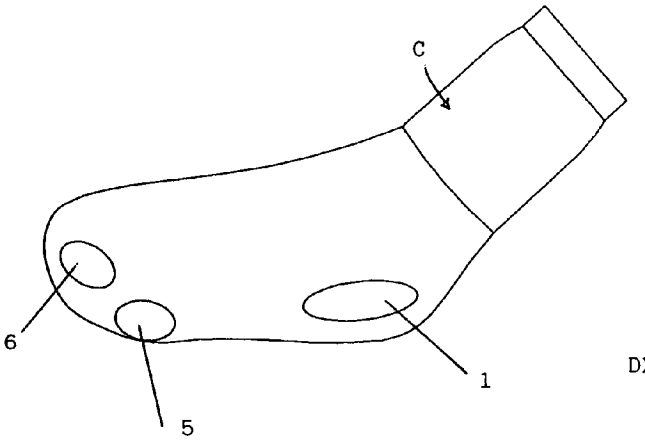

As a matter of fact, the best results shall be obtained by positioning two plates 1, 2 at the heel, two further plates 3, 4 at the external edge (with reference to the foot of the user), while a further plate 6 shall be arranged at the big toe. Lastly, the last plate 5 shall be arranged between the latter plate 6 arranged at the big toe and the upper plate 4 arranged at the external edge of the sock. The same thing is clearly visible observing FIGS. 2 and 3, which refer to a right sock, as well as FIGS. 4 and 5, which refer to a left sock.

According to P. Dudal's theory already mentioned, the various plates are arranged at the following muscular chains:

1-2 Plantaris pedis (rear muscular chain)

3—Peroneo tertius (side muscular chain)

4—Abductor digiti minimi pedis (side muscular chain).

5—Flexor digitorum longus et accessorius (rear muscular chain).

6—Point zero, also referred to as the step end-point (big toe of the wearer).

It is hereby specified that the present finding regards all socks, for men and for women and not only the socks illustrated previously. In particular, the socks shall be particularly useful for practicing sports and physical activities in general, while the stockings in particular shall be used by women for resting and for activities requiring a standing posture for extended periods (hours) of time (hairdressers, beauticians, ironers, shop assistants, etc.)

As a matter of fact, the device subject of the finding is not restricted only to a sock or a stocking as described above, but regards any article to be arranged at the sole of the foot. A non-limiting example of this article could be made up of a sole to be interposed between the sole of the user's foot and the sole of the footwear.

Through an alternative embodiment, the article could be made up of the sole of a footwear, wherein the plates made of flexible material containing ferrite could be arranged on the surface which will end up being laid at the sole of the foot.

The thickness of the various plates shall advantageously be in the range of 0.5 to 1 mm, even through thickness varying between 1 to 2 mm can be tolerated. Tests carried out have proved that, by using the socks subject of the finding it is possible to obtain considerable advantages both from a static point of view—in the sense that the user is capable of simply staying on his feet for a very long period of time without having any problems—and from a dynamic point of view,—in the sense that the user is capable of practicing sports and physical activities in general—without having any problems also in this case.

Synthetic material referred to as "plastoferrite", well known to men skilled in the art, could be advantageously used for making the plates.

In particular, the socks subject of the finding proved to be particularly adapted to avoid problems for golf players, who are usually subjected to the abovementioned problems, especially when carrying out the so-called "swing" at any shot taken using the club.

The invention claimed is:

1. A sock adapted to provide a stimulus to a wearer's foot resulting in advantages in practicing sports and physical activities having a sole portion of the sock arranged adjacent to the sole of the wearer's foot wherein a longitudinal axially directed line extends from the toes to the heel demarcating the sole portion of the sock into an internal sole portion and an external sole portion and wherein a plurality of separate plates integral with the sole portion of the sock and formed of flexible material containing ferrite is disposed on an exterior surface of the sock, said plurality of separate plates consisting of:

a first plate (1) arranged only on the internal sole portion at the wearer's heel and positioned at a plantaris pedis rear muscular chain of the wearer;

a second plate (2) arranged only on the external sole portion at the wearer's heel and positioned at the plantaris pedis rear muscular chain of the wearer;

a third plate (3) arranged only on the external sole portion and positioned at a peroneo tertius side muscular chain of the wearer;

a fourth plate (4) arranged only on the external sole portion and positioned at an abductor digiti minimi pedis side muscular chain of the wearer, wherein said second, third, and fourth plates are arranged in substantial alignment along a lateral edge of said external sole portion and said first plate is arranged along a lateral edge of said internal sole portion;

a fifth plate (5) positioned at a flexor digitorum longus et accessorius rear muscular chain of the wearer; and a sixth plate (6) positioned at a big toe of the wearer, wherein said fifth plate is disposed between said fourth and sixth plates, wherein the sixth plate is disposed at a first distance from a rear portion of the sole portion of the sock, the rear portion being near the first and second plates, wherein the fifth plate is disposed at a second distance from the rear portion of the sole portion of the sock, wherein the fourth plate is disposed at a third distance from the rear portion of the sole portion of the sock, wherein the third plate is disposed at a fourth distance from the rear portion of the sole portion of the sock, wherein the first distance is greater than the second distance, the second distance is greater than third distance, and the third distance is greater than the fourth distance.

2. The sock according to claim 1, wherein the plurality of separate plates each have a thickness in a range of 0.5 mm and 2 mm.

3. The sock according to claim 1, wherein the plurality of separate plates each have a thickness in a range of 0.5 mm to 1 mm.

4. The sock according to claim 1, wherein the flexible material of the first, second, third, fourth, fifth, and sixth plates is plastoferrite.

* * * * *